United States Patent [19]

Drullinger

[11] Patent Number: 4,789,779

[45] Date of Patent: Dec. 6, 1988

[54] HEAT PIPE OVEN MOLECULAR BEAM SOURCE

[75] Inventor: Robert E. Drullinger, Boulder, Colo.

[73] Assignee: The United States of America as represented by the Secretary of Commerce, Washington, D.C.

[21] Appl. No.: 35,211

[22] Filed: Apr. 9, 1987

Related U.S. Application Data

[63] Continuation of Ser. No. 802,875, Nov. 29, 1985, abandoned, which is a continuation-in-part of Ser. No. 636,769, Aug. 1, 1984, Pat. No. 4,558,218.

[51] Int. Cl.[4] ..... H05H 3/02

[52] U.S. Cl. ..... 250/251; 219/274

[58] Field of Search ..... 250/251; 219/274

[56] References Cited

U.S. PATENT DOCUMENTS 4,558,218 12/1985 Drullinger ..... 250/251

OTHER PUBLICATIONS

Swenumson et al., Rev. Sci. Instrum., 52(4), Apr. 1981, pp. 559–561.

*Primary Examiner*—Bruce C. Anderson
*Assistant Examiner*—Jack I. Berman
*Attorney, Agent, or Firm*—Thomas Zack; Alvin Englert; Kirk M. Hudson

[57] ABSTRACT

A recirculating oven molecular beam source of unitary construction comprises a shaped porous wicking oven substrate nearly saturated with the working material and having a cavity with source and collimating regions formed therein.

20 Claims, 2 Drawing Sheets

FIG 1A
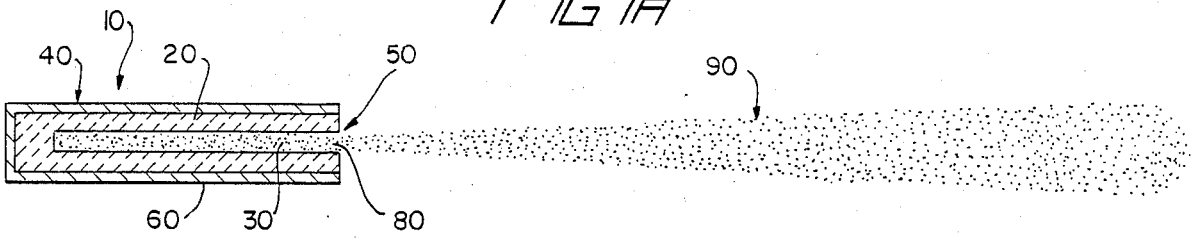
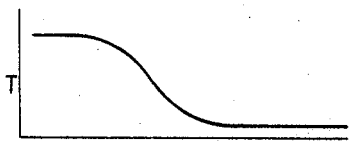
FIG 1B
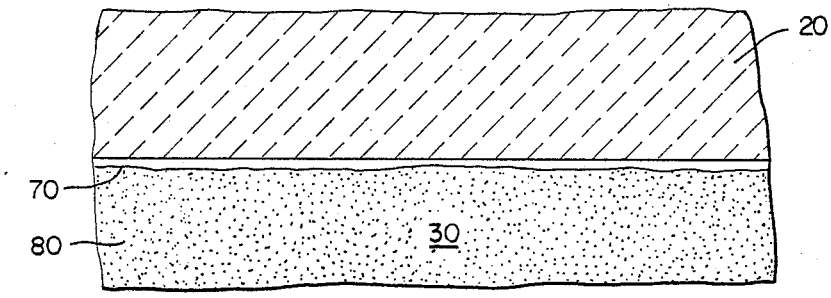
FIG 2
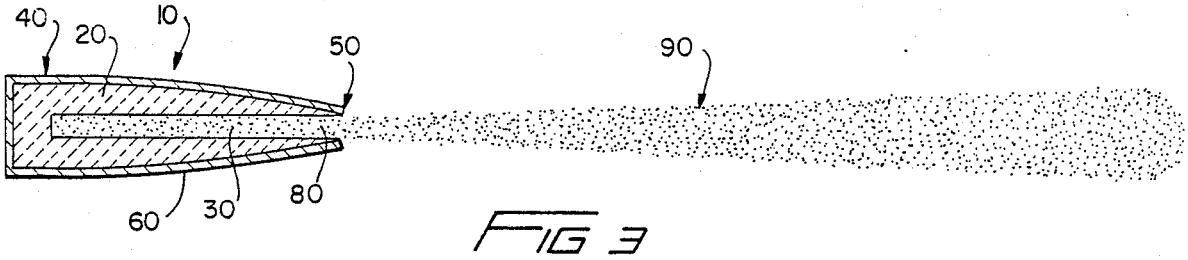
FIG 3
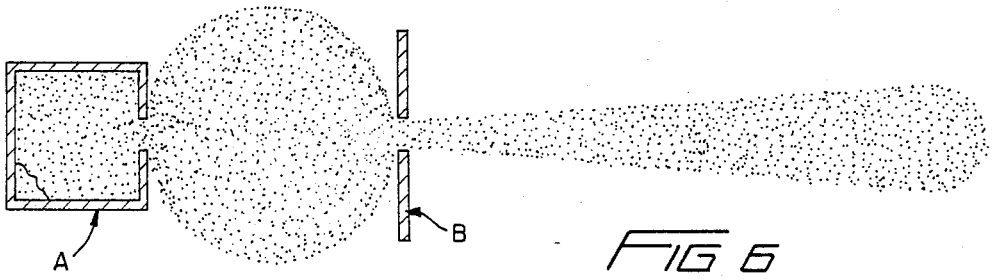
FIG 6
(PRIOR ART)
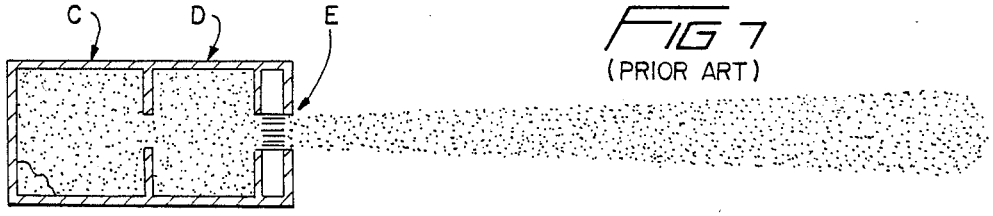
FIG 7
(PRIOR ART)

HEAT PIPE OVEN MOLECULAR BEAM SOURCE

CROSS-REFERENCE TO RELATED APPLICATION

This application is a continuation of application Ser. No. 802,875, filed Nov. 29, 1985, now abandoned, which is a continuation-in-part of application Ser. No. 636,769, filed Aug. 1, 1984, and now issued as U.S. Pat. No. 4,558,218, dated Dec. 10, 1985.

BACKGROUND OF THE INVENTION

Atomic and molecular beam machines are powerful, widely used devices in the laboratory study of atomic and molecular properties, but they also find practical application in devices such as portable atomic frequency and time standards. In this latter application, they are integral parts of precision navigation and communications systems and frequently are used in highly dynamic or space environments. As the discussion throughout this application applies equally to most atomic and molecular materials from which one might form a beam, the two terms ("atom" and "molecule") will be used interchangeably throughout.

The on-axis flux in atomic beam ovens depends primarily on the source vapor pressure. Atomic beam ovens can be classified into three classes, referred to herein as dark-wall, bright wall and recirculating ovens, according to the manner in which the off-axis flux is controlled. Ideally, the collimation of the beam should involve simple geometric shadowing, that is, the collimator should just cut off the source emission in undesirable directions. However, it is difficult to achieve this end without introducing certain undesirable characteristics. For example, in a dark-wall oven for cesium atoms, a carbon collimator can be used to absorb every cesium atom which strikes it, thus achieving the desirable end, but the carbon soon saturates and the cesium deposited on the walls is either re-evaporated or, if it sticks, causes a change in the size of shape of the collimator. The dark-wall oven demonstrates a key problem in oven design, that is, dealing with the flux which strikes the walls of the collimator.

Conventional bright wall ovens use arrays of long narrow tubes to achieve good collimation. The array of narrow tubes allows for higher beam flux and for a good length-to-diameter (collimation) ratio in a short oven. To prevent these tubes from building up deposits of skimmed material, they are maintained at an elevated temperature and atoms which strike the wall are then re-evaporated with a cos ($\theta$) distribution, wherein $\theta$ is the angle with respect to the normal to the source surface, as defined in Ramsey, N. F., *Molecular Beams*, Clarendon Press, Oxford (1956).

For a collimator of uniform cross section this process of absorption and re-emission of atoms leads to a vapor pressure which varies linearly between the pressure at the source and zero at the emitting end of the tube. This re-emission from the walls broadens the beam profile well beyond that produced by dark-wall ovens, but such bright-wall ovens have nonetheless proven to be very workable. If position along the tube is measured relative to the forward end, then the rate at which atoms are emitted from a wall-surface element at a distance z from the end of the tube is proportional to z. This assumption is not strictly valid at the front of the tube where an end correction should be made, but it appears to provide a good description of the central portion of the beam profile.

In a recirculating oven, wicking apparatus is provided to return collimated flux through capillary action for re-use by the source.

FIGS. 6 and 7 illustrate specific examples of well known prior art ovens. FIG. 6 shows the type of stable oven that would be used in a laboratory beam machine which does not need to operate over a long time period. The working material is contained in a heated chamber A and some of the vapors are allowed to escape through a small hole. The expanding cloud of vapor is intercepted by a collimater B which allows atoms with the correct trajectory to pass down the beam line. The total amount of material emitted through the oven hole can be shown to be:

$$Q_o = \frac{1}{4} n\bar{v}A_s$$

where n is the number density of atoms or molecules in the oven chamber, $\bar{v}$ is their mean thermal velocity and $A_s$ is the area of the source hole. If the collimator hole can be characterized by a radius, r, separated from the oven hole by a distance, L, then the material emitted into the beam can be shown to be:

$$Q_b = Q_o\left(\frac{r}{L}\right)^2$$

Thus, if L is very much larger than r, the effect of the collimator is to reduce substantially the total amount of material injected into the beam machine without affecting the on-axis beam flux.

The problem with this oven is the excessive amount of material which leaves the oven chamber but does not contribute to the beam. This material must be trapped behind the collimator. It cannot be allowed to find its way into the beam area or to plug the collimator.

The oven shown in FIG. 7 was developed in an attempt to deal with this problem. The working material is contained in a heated chamnber C and some of the vapors allowed to expand into a second chamber D at a slightly higher temperature. From here vapors pass through a multi-channel array E and into the beam chamber. The process of passing through the multi-channel array creates a quasi-collimated beam. The tubes of the collimator array are "bright wall" tubes, that is, any atom or molecule which strikes the wall of the tube must subsequently reevaporate and come back off the wall. Most of the atoms which enter a collimator tube return to the oven, while a smaller number travel the length of the tube and exit as part of the collimated beam. The effect of the "bright walled" tube collimator is to leave the forward directed flux unchanged, but to reduce the total amount of material leaving the oven to:

$$Q_b = Q_o\left(\frac{8r}{3L}\right)$$

where r is the tube radius and L is its length.

While this device in part solves the excessive emission problem of the oven shown in FIG. 6, it suffers from several problems of its own. The collimation effect for a given aspect ratio (collimator hole area to length) has been reduced from $$\left(\frac{L}{r}\right)^2$$

in the oven of FIG. 6, to $$\frac{3L}{8r},$$

resulting in an increase in the amount of non-useful material injected into the beam area, material which can have long-term detrimental effects. The oven also requires anti-spill structures when used in a non-laboratory application, and with some materials, particularly those of interest to time standards, the small holes of the multichannel array have shown some tendency periodically to plug and unplug, giving rise to a spatially non-uniform and unstable beam.

A recirculating oven device which is considerably more complicated than the present invention is disclosed in R. D. Swenumson and U. Even, "Continuous Flow Reflux Oven as the Source of an Effusive Molecular Cs Beam," Rev. Sci. Instrum., 52(4): 559–561 (April 1981). This device uses a series of non-wicking baffles and collimators to provide the collimation effect, and a steel mesh to provide capillary action to return excess material caught by the baffles to the oven chamber. Its disadvantages include its complexity, its sensitivity to orientation and acceleration and the difficulty of reducing the size of the oven for commercial applications. In addition, its structure gives rise to condensate induced changes in beam shape and even plugging in the case of small source holes or the absence of gravity.

SUMMARY OF THE INVENTION

These and other disadvantages of the prior art are overcome in accordance with the present invention by integrating the functions of the reservoir, evaporator, collimator and return structure of conventional recirculating ovens into a single block of porous wicking material with a collimating chamber in it. The porous wicking structure in the present inventon makes useful a formerly wasteful aspect of the oven of FIG. 6. The operation of a single hole oven followed by a single hole collimator as shown in FIG. 6 is unaffected by the shape of the chamber between the source and the collimator hole so long as that chamber removes all non-beam atoms. In fact, the hole in the oven and the collimator hole would be the two ends of a straight tube if the chamber's interior walls looked like a "black hole" to any atom which struck them, i.e., if any material skimmed by the chamber walls did not return to the vapor phase and did not build up on the walls changing the shape of the chamber. Such a device can be achieved in accordance with the present invention using an oven of porous wicking substrate nearly saturated with the working material and operated just above the melting point of that material.

An atomic beam source or molecular beam source constructed in accordance with the present invention comprises a porous wicking oven substrate (which as used herein means the body of the oven) which is nearly saturated with the working or source material for the beam and which has at least one cavity formed therein having at least one exterior output opening or orifice. The oven is heated so as to maintain a temperature gradient between the orifice and portion of the substrate remote from the orifice so as to create a source region for providing evaporated working material molecules in line of sight with the orifice, and a collimating region including at least a portion of the cavity for collimating the evaporated working material molecules to form the molecular beam and for recirculating working material condensate to the source region of the substrate.

The only requirement for the geometry of an oven constructed in accordance with the present invention is that the "effective source", i.e., the location where an evaporated beam molecule begins its final trajectory, whether that be from a surface of the oven or its last collision with other molecules within the oven, must be in line of sight with the corresponding output orifice. The collimating chamber need not be cylindrical, centrally located or axial with the source end.

In accordance with the present inventon, the oven is heated to just above the melting point of the source material. Capillary wetting action then causes a thin layer of the liquid source material to develop on the oven surfaces. If the temperature of the source end is raised so that the source material begins to evaporate rapidly, vapor fills the cavity (collimating chamber) between the source end and output end and expands toward the output end.

Since the inner wall of the oven defining the collimating chamber is coated with a thin liquid layer of the source material, when an atom strikes the wall, it actually strikes a surface of its own liquid near its melting point. For most materials these conditions will result in sticking collisions. In particular, metal atoms will not bounce off their own liquid.

As material is evaporated from the source end (hot zone) and condensed in the cooler collimating chamber, capillary forces will act to move the condensate into the walls of the collimator chamber and back to the evaporation region at the source end. Hence, the porous collimator chamber of the present invention acts as a "black walled" collimator and as such obeys the analysis for ovens of the type discussed above in connection with FIG. 6, i.e., $$Q_b = Q_o\left(\frac{r}{L}\right)^2$$

The source material saturating the oven substrate constitutes the reservoir of source material for the device. Since this means that no pool of source material exists in the device and as capillary action is insensitive to position and acceleration (gravitation), the beam source as a whole is insensitive to orientation and acceleration.

In addition to the interior walls of the collimator chamber, the exposed front surface of the collimator is coated with working material. Although at a comparatively low temperature, this front surface will emit some non-collimated flux into the beam machine. In a small number of highly sensitive or low flux applications, this extraneous emission may be undesirable. Three design techniques which all but eliminate this emission are available.

First, as shown in FIG. 3, the exposed front surface of the saturated wicking material can be made arbitrarily small, either by tapering the collimator wall to nearly negligible thickness at the output end, or simply by using a very thin collimator wall. In either case, the corresponding loss of reservoir volume can be made up by the addition of extra porous material in the hot evaporator region.

Second, the porosity of the substrate may be varied within the oven. The vapor pressure of material contained in capillary structures can be significantly reduced from that of the bulk material. This reduction is a function of the shape of the meniscus formed as a result of the wetting action of the working material on the wicking structure. Hence, by selecting the appropriate pore size and wicking substrate, one can control this potential source of undesirable emission. With smaller capillary channels and a more strongly wetted wicking substrate, the vapor pressure can be depressed. Conversely, in the evaporator region, the use of large pore, weakly wetted substrate can increase the vapor pressure of the working substance to near its bulk material value. Inasmuch as the emission of source material from the walls of the collimator is such that the device output hole appears to emit material at the same rate as the saturated wicking substrate around it, adjusting the porosity in this fashion effectively adjusts the rate at which the material is emitted.

Third, a bright wall collimator may be applied to the end of the oven. Advantageously, the reservoir portion may be large and wrapped around the collimator portion, which has a short thin-walled intermediate section and a thicker walled end section to which the bright wall collimator is mounted. The oven is heated to achieve a temperature gradient across the intermediate section of the collimator portion, while the end section is held at a uniform lower temperature somewhat lower than the temperature of the bright wall collimator.

As is apparent, the result is a device of extreme simplicity which readily may be altered to provide beams of varying sizes and shapes simply by altering the relative dimensions of the device. The complexity, position and acceleration sensitivities of the prior art devices are effectively eliminated.

Other features and advantages of the present invention are disclosed in or apparent from the following detailed description of preferred embodiments.

BRIEF DESCRIPTION OF THE DRAWINGS

The following drawings, in which like letters and numbers refer to like elements, are used in describing, without limitation, the claimed invention:

FIG. 1(*a*) is a cross-sectional view of a preferred embodiment of the present invention;

FIG. 1(*b*) is a graph representing the temperature of the embodiment shown in FIG. 1(*a*) at different points along its length;

FIG. 2 is a cross-sectional detail of the surface of the central bore of the embodiment shown in FIG. 1(*a*);

FIG. 3 is another preferred embodiment of the present invention;

FIG. 5(*b*) is a graph representing the temperature profile of the cavity portion of the embodiment shown in FIG. 5(*a*);

FIG. 6 is a first prior art beam source; and

FIG. 7 is a second prior art beam source.

DETAILED DESCRIPTION OF THE PREFERRED EMBODIMENTS

Figure 4A:
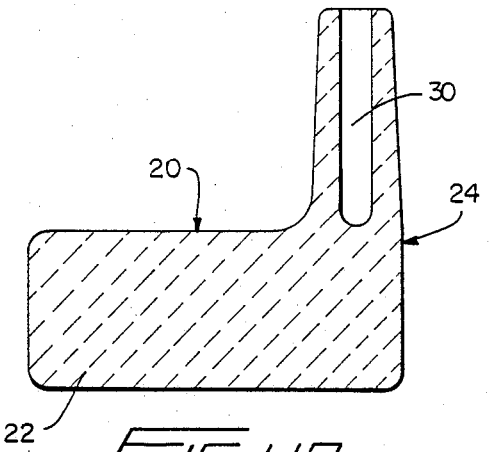
FIGS. 4(*a*) and 4(*b*) represent further preferred embodiments of the invention.

In FIG. 1(*a*), a heat pipe oven molecular beam source 10 is constructed of a porous wicking substrate 20. The substrate 20 has a central cavity or bore 30 formed therein and extending from a closed source end 40 to an open output end 50. The exterior of said substrate 20 exclusive of said output end 50 should be non-porous or, alternatively, should be enclosed by a relatively non-porous casing 60, as shown.

The substrate 20 is nearly saturated with the source material for the beam. The source material may be any suitable substance of which a beam of material is desired, including, but not limited to, cesium and other similar metals, alkali metals, and suitable organic compounds such as formaldehyde. Conventional heat means (not shown), such as external resistive coils or resistive self-heating, are provided to maintain the temperature of the oven 10 slightly above the melting point of the source material. Capillary wetting action then develops a thin liquid layer 70 of the source material over the entire surface of central bore 30, as best seen in FIG. 2.

To generate a beam, the temperature at the source and 40 of oven 10 is raised somewhat above the melting point of the source material, thereby causing increased evaporation of the source material from the liquid layer 70. Meanwhile, the temperature close to the output end 50 of oven 10 is maintained only slightly above the melting point of the source material, as indicated in the graph in FIG. 1(*b*), wherein the vertical axis represents the temperature of oven 10 and the horizontal axis represents the position along the bore 30 of oven 10.

As indicated in FIG. 1(*a*), but best seen in FIG. 2, the heating of the oven at the source end 40 causes some of the source material to go into a vapor form 80. A portion of this vapor will subsequently comprise the beam 90. In particular, only that portion of the vapor 80 which passes from its evaporation point along the bore 30 without striking the liquid layer 70 will pass through the output end 50 and become a portion of the beam 90. Any of the material 80 which strikes the liquid layer 70 will condense and be drawn back into the substrate 20 by capillary action.

This same capillary action serves to distribute the source material throughout the substrate 20. In addition, the porous substrate 20 acts as a reservoir of the source material by storing it in the pores of substrate 20.

The output end 50 is left uncovered to prevent the undesired accumulation of source material on the casing 60. In very low flux or high sensitivity situations where the small amount of non-colimated flux from the uncased output end 50 is unacceptable, the output end 50 may be tapered to reduce this effect, as shown in FIG. 3. One of the consequences of such tapering is the loss of the reservoir capacity represented by the substrate 20 which has been removed to form the taper. This loss may be compensated for by adding more substrate material (and hence more reservoir capacity) at the source end 40 of the oven 10, also shown in FIG. 3.

The only geometrical requirement for an oven constructed in accordance with the present invention is that the final trajectory of evaporated molecules which form the beam must be in line of sight with the final aperture/orifice or output end opening. The shape of the oven may vary, and the shape and orientation of the cavity within the oven may also vary. However, advantageously the oven substrate is configured so as to minimize the amount of working material used in the collimating portion or region, and to maximize the reservoir capacity of the source region. Further, the substrate advantageously is configured to minimize the power flow from the hotter source region to the cooler collimating region, as well as the effect of the temperature coefficient of the capillary action which causes the working material to try to move away from the source region, where it is needed for maximum beam flux, to the collimating region. A substrate having a relatively large source region and a relatively long, narrow, thin-walled collimating region both maximizes the ratio of the volume of the source region to the volume of the collimating region, and minimizes the thermal conductivity of the substrate portion across which a temperature differential must be maintained, as well as providing maximum collimation.

Figure 4B:
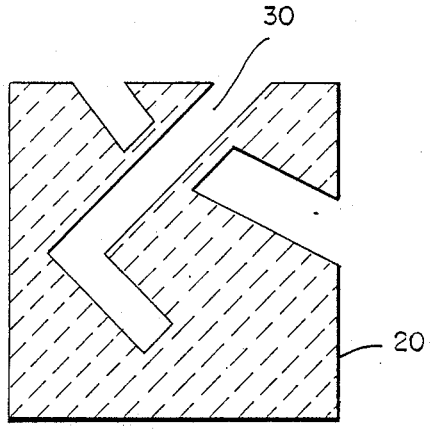

Three illustrative embodiments which incorporate these features are illustrated in FIGS. 4(*a*), 4(*b*) and 5(*a*). In the embodiment illustrated in FIG. 4(*a*), the substrate 20 is L-shaped, with the foot portion 22 which forms the source region of the oven being relatively large compared to the elongate thin stem portion 24 containing collimating chamber cavity 30 which forms the collimating region. In the embodiment illustrated in FIG. 4(*b*), the substrate 20 has a generally square configuration, and the cavity 30 has an angled configuration and a non-axial, off-center orientation. Substrate 20 advantageously is notched in the collimating region (adjacent cavity 30, as shown) to decrease the thermal conductivity of the collimating region portion of the substrate. In the embodiment illustrated in FIG. 5(*a*), the substrate 100 has a complex generally T-shaped geometry, as viewed in cross-section, wherein the source portion 40 is configured as a relatively thick annular ring as shown, and the collimating chamber defining portion 60 is coaxial with the source portion 40 and is configured as a generally cylindrical pipe having a thin-walled section 62 connected to the source portion 40 and a thick walled end section 64 having an open output end 50, as shown.

As noted hereinabove, an oven constructed in accordance with the present invention is heated such that there is a hotter source region and a cooler collimating region, thereby creating a temperature gradient between the source portion and the output orifice portion of the substrate. Ideally, as the source material is depleted, the surface of the source portion of the substrate and the collimating portion should remain saturated with the source material. However, the temperature gradient in the substrate results in a force which acts on the contained source material in a direction opposite to the gradient, that is, source material is forced from the hot toward the cold region of the substrate. Advantageously, the heater apparatus is placed so as to apply the main heating power to the part of the source portion which is most distant from the surface of the source portion where evaporation occurs, resulting in a slight temperature gradient across the source region as well as the primary gradient across the collimating region. Consequently, as working material is consumed in the beam and the reservoir of working material in the source region begins to dry out, the remaining working material will stay at the effective evaporating surface, and the beam flux will remain stable over the like of the charge of working material in the substrate.

Aside from the basic requirement that there be a hotter source region and a cooler collimating region, and hence, some temperature gradient across the oven substrate, the precise shape of the temperature gradient is not critical. The gradient may vary substantially linearly over the entire length of the substrate portion defining the collimating chamber cavity, or may vary over a substantial section of the cavity portion nearer the source portion and be substantially constant adjacent the output end of the substrate, as shown in FIG. 1(*b*). Alternatively, the gradient may vary sharply at the boundary between the source and collimating chamber portions of the substrate, such that substantially the entire collimating chamber portion of the substrate is maintained at a substantially uniform temperature $T_2$ which is slightly above the melting point of the source material but below the source portion temperature $T_1$ which causes evaporation of the source material. Such an oven should produce a central beam profile which is very close to that of a dark wall oven, without significant reduction in the total integrated flux compared to an oven in which the temperature varies over the entire length of the collimating chamber portion of the substrate. Additionally, such an oven should be able to have a parallel tube structure similar to that of conventional ovens used in commercial standards.

Figure 5A:
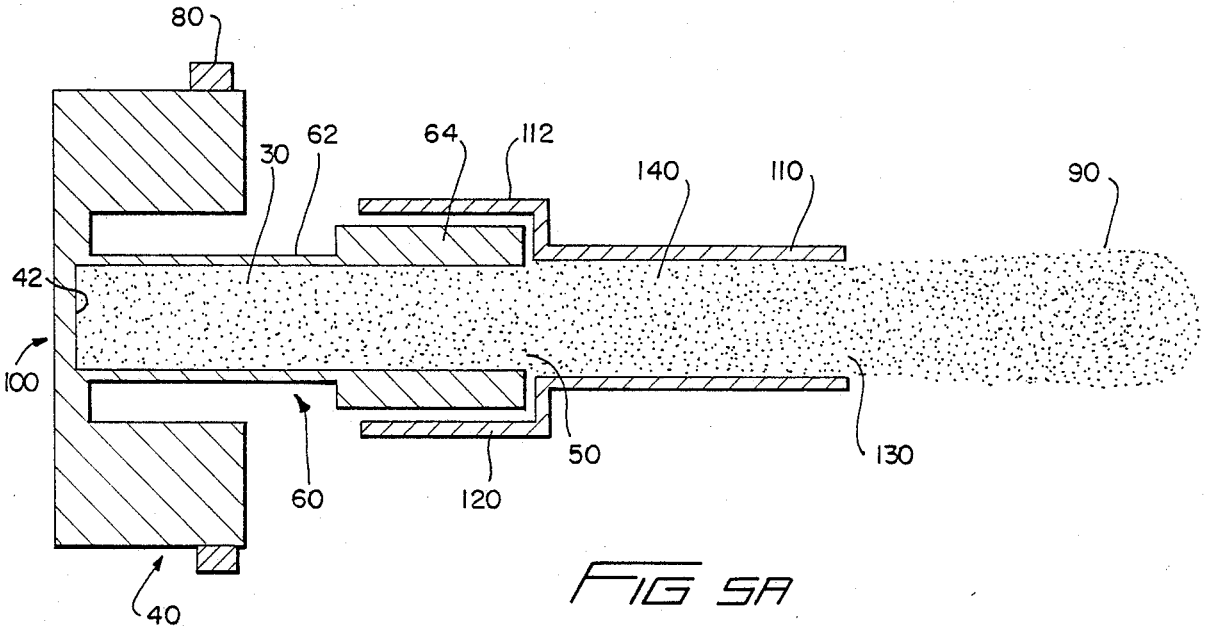
FIG. 5(*a*) represents another preferred embodiment of the present invention.
Figure 5B:
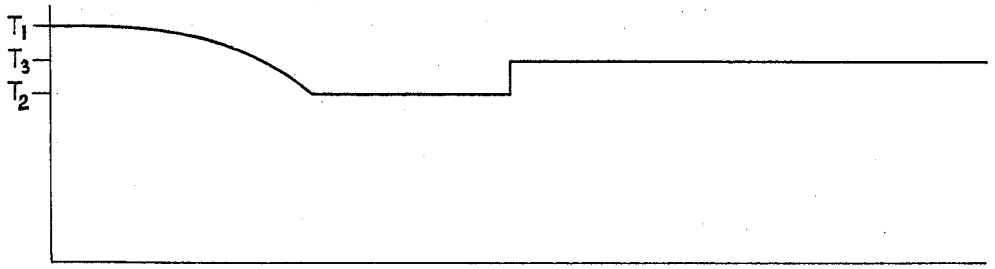

Referring to FIG. 5(*a*), a beam source constructed in accordance with the present invention advantageously further comprises a bright-wall collimator 110 coupled to the end of an oven substrate 100 constructed in accordance with the present invention. Oven substrate 100 advantageously has the configuration shown in FIG. 5(*a*) and described hereinabove. Collimator 110 may be conventional in design, having a collimating chamber 140 and a mounting portion 112 for cooperating with the collimating chamber portion 64 of oven substrate 100 to mount collimator 110 coaxially on substrate 100. Advantageously, the oven beam source is heated such that the source portion 40 of oven 100 is maintained at a temperature $T_1$ which causes evaporation of source material to form beam molecules; and, as shown in the FIG. 5(*b*) graph of the temperature gradient along the axis of cavity 30 and collimator 110, a temperature gradient exists across intermediate section 62 of the collimating chamber portion 60 of oven 100; the end section 64 of the collimating chamber portion 60 is maintained at a substantially uniform temperature $T_2$ which is lower than temperature $T_1$ and slightly above the melting point of the source material, and bright wall collimator 110 is maintained at a temperature $T_3$, slightly above temperature $T_2$, which is appropriate for bright wall collimation. Further, the heating apparatus, schematically shown as element 80, advantageously is placed as shown in FIG. 5(*a*) on the source portion 40 of the oven substrate at a location remote from the evaporating surface 42 of the source portion, such that a slight temperature gradient also exists across source portion 40, with the temperature decreasing in a direction away from the heater location toward the minimum source region temperature $T_1$ at evaporating surface 42.

The substrate itself may be comprised of any suitably porous materials, the only limiting criterion being that the working material must wet, but not otherwise chemically react with, the substrate. Substrates have been formed of various sintered metals, including tungsten, molybdenum and stainless steel. Depending on the working material, suitably porous metals, including nickel and copper in addition to those already listed, should also form suitable substrates, as should various alumina silicates for non-metallic working materials. A water beam source has been constructed using cloth gauze as the substrate.

In forming the substrate, it is crucial that the surface of the collimating chamber remain porous. Simply drilling a bore into a block of substrate may tend to smear the substrate and close the pores on the surface of the bore. The bore must then be chemically etched to reopen the pores. Suitable pre-bored substrates are available commercially from Spectra-Mat Inc. of Watsonville, Calif.

A specific example is provided for illustrative purposes only: a pre-bored sintered tungsten substrate obtained from Spectra-Mat Inc. was nearly saturated with cesium, which has a melting point of 28.4° C. A beam was produced by heating the output end 50 of the device to 30° C. and the source end 40 to varying temperatures between 80° and 120° C. As would be expected, the total beam flux increased as the source end temperature increased.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered examplary in nature and not limiting the scope and spirit of the invention as set forth in the appended claims.

What is claimed is:

1. A molecular beam machine source comprising:

a porous wicking oven substrate nearly saturated with a working material and having at least one cavity formed therein, said substrate surrounding said cavity having a source region, a collimating region, and an orifice communicating with the exterior of the substrate; and means maintaining a temperature gradient along said source and collimating regions for providing evaporated working material molecules in line of sight with said orifice, said collimating region of said substrate collimating evaporated working material molecules to form a molecular beam and recirculating working material condensate to said source region.

2. The molecular beam machine source of claim 1 wherein substantially all of said cavity is part of said collimating region.

3. The molecular beam machine source of claim 1 wherein the minimum temperature of said source region is above the melting point of said working material and the maximum temperature of said collimating region is lower than said minimum source region temperature.

4. The molecular beam machine source of claim 1 wherein said oven substrate is cylindrical and an axially extending bore formed in one end of said substrate constitutes said at least one cavity.

5. The molecular beam machine source of claim 1 wherein said source region of said substrate has a large volume relative to the volume of said collimating region.

6. The molecular beam machine source of claim 1 wherein said substrate is configured such that said collimating region has a lower thermal conductivity than said source region.

7. The molecular beam machine source of claim 5 wherein said collimating region is elongate and thin-walled compared to said source region.

8. The molecular beam machine source of claim 6 wherein said collimating region is elongate and thin-walled compared to said source region.

9. The molecular beam machine source of claim 1 further comprising bright wall collimating means having at least one collimating chamber mounted to said oven substrate such that said bright wall collimating chamber is aligned with said orifice.

10. The molecular beam machine source of claim 9 wherein said collimating region has a first thin-walled section adjacent said said substrate source region and a second thick-walled section adjacent said bright wall collimating means, and said source region is maintained at a first minimum temperature, said thick-walled section of said collimating portion is maintained at a second maximum temperature lower than said first temperature, and said bright wall collimating chamber is maintained at a third minimum temperature above said second temperature.

11. The molecular beam machine source of claim 10 wherein a temperature gradient is maintained across said source region, and said thick-walled section is maintained at a second temperature which is substantially uniform between said thin-walled section and said orifice.

12. The molecular beam machine source of claim 10 wherein said first and third temperatures are substantially the same.

13. The molecular beam machine source of claim 1 wherein said source region is angled with respect to said collimating region.

14. The molecular beam machine source of claim 1 comprising first and second cavities which are connected together end-to-end to form a continuous angled cavity.

15. The molecular beam machine source of claim 1, wherein said substrate is thicker away from said orifice than near said orifice.

16. The molecular beam machine source of claim 3 wherein a temperature gradient is maintained across said source region such that the surface of said source region from which working material is evaporated is maintained at said minimum source region temperature and working material in said source region is urged toward said evaporation surface.

17. The molecular beam machine source of claim 1, wherein the pores of said porous substrate are larger away from said orifice than near said orifice.

18. The molecular beam machine source of claim 1, wherein said substrate is selected from the group consisting of tungsten, molybdenum, stainless steel, nickel, copper and the alumina silicates.

19. A molecular beam source comprising:

a porous substrate having at least one cavity, a source region, a collimating region, and an opening to the exterior of the substrate;

working material nearly saturating said substrate such that a thin liquid layer of said working material covers the surface of said source and collimating regions; and means for maintaining the temperature of said substrate such that working material is evaporated from said source region and evaporated working material is collimated by said collimating region.

20. The molecular beam machine of claim 19, wherein said cavity is centrally located in said substrate.

* * * * *